US010028342B2

(12) United States Patent
Willaert et al.

(10) Patent No.: US 10,028,342 B2
(45) Date of Patent: Jul. 17, 2018

(54) CIRCUIT FOR DRIVING A LOAD

(71) Applicant: PHILIPS LIGHTING HOLDING B.V., Eindhoven (NL)

(72) Inventors: Jurgen Margriet Antonius Willaert, Eindhoven (NL); Joost Jacob Brilman, Eindhoven (NL); Erik De Wilde, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/500,931

(22) PCT Filed: Jul. 20, 2015

(86) PCT No.: PCT/EP2015/066543
§ 371 (c)(1),
(2) Date: Feb. 1, 2017

(87) PCT Pub. No.: WO2016/016034
PCT Pub. Date: Feb. 4, 2016

(65) Prior Publication Data

US 2017/0231042 A1 Aug. 10, 2017

(30) Foreign Application Priority Data

Aug. 1, 2014 (EP) ..... 14179511

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0845
(Continued)

(56) References Cited

U.S. PATENT DOCUMENTS 6,081,131 A * 6/2000 Ishii ..... H03K 19/018571 326/68
7,227,399 B2 * 6/2007 Ajram ..... H03K 5/003 326/68

(Continued)

FOREIGN PATENT DOCUMENTS

JP 2013110636 A 6/2013
JP 2014517466 A 7/2014

(Continued)

*Primary Examiner* — Don Le

(57) ABSTRACT

A driver circuit comprising: output circuitry for connecting the circuit to a load, the output circuitry comprising one or more energy-storing components; switching circuitry arranged to supply power from a power supply to the load by supplying a current through at least one of the energy-storing components that resists a change in current, or applying a voltage across at least one of the energy-storing components that resists a change in voltage; and control circuitry arranged to control the switching circuitry, to cause the above-mentioned current or voltage to oscillate between an upper envelope and a lower envelope. The control circuitry is configured to modulate data into this current or voltage by shifting the upper envelope between at least a first amplitude level and a second amplitude level, and by shifting the lower envelope by the same amount in the same direction at the same time.

12 Claims, 12 Drawing Sheets

(58) Field of Classification Search
USPC ..... 315/291, 294
See application file for complete search history.

(56) References Cited

U.S. PATENT DOCUMENTS

| | | | | |
|---|---|---|---|---|
| 8,421,518 | B2 * | 4/2013 | Larsen | H03K 3/356165 326/62 |
| 8,446,173 | B1 * | 5/2013 | Faucher | H03K 19/00361 326/27 |
| 2008/0036490 | A1 * | 2/2008 | Kim | H03K 19/007 326/14 |
| 2009/0128191 | A1 * | 5/2009 | Ku | H03K 19/018571 326/81 |
| 2014/0070728 | A1 | 3/2014 | Pflaum | |
| 2014/0232710 | A1 * | 8/2014 | Low | G09G 3/3696 345/211 |
| 2014/0368128 | A1 * | 12/2014 | Elferich | H02M 1/15 315/297 |
| 2015/0280701 | A1 * | 10/2015 | Park | H03K 17/08 327/379 |
| 2017/0117883 | A1 * | 4/2017 | Green | H03K 3/356104 |

FOREIGN PATENT DOCUMENTS

| | | | |
|---|---|---|---|
| WO | WO2013046160 | A1 | 4/2013 |
| WO | WO2013053869 | A1 | 4/2013 |

* cited by examiner

CIRCUIT FOR DRIVING A LOAD

CROSS-REFERENCE TO PRIOR APPLICATIONS

This application is the U.S. National Phase application under 35 U.S.C. §371 of International Application No. PCT/EP2015/066543, filed on Jul. 20, 2015, which claims the benefit of European Patent Application No. 14179511.2, filed on Aug. 1, 2014. These applications are hereby incorporated by reference herein.

TECHNICAL FIELD OF THE INVENTION

The present disclosure relates to a driver circuit such as a buck converter for driving a load such as an LED or array of LEDs.

BACKGROUND OF THE INVENTION

Coded light refers to techniques whereby data is embedded in the visible light emitted by a light source such as an everyday luminaire. In the case of such a luminaire, the light thus comprises both a visible illumination contribution for illuminating a target environment such as room (typically the primary purpose of the light), and an embedded signal for providing information into the environment. To do this, the light is modulated at a certain modulation frequency or frequencies, preferably a high enough frequency so as to be beyond human perception and therefore not affecting the primary illumination function. It is also possible that data may be transmitted using a dedicated coded light source, in which case the modulation may or may not be beyond human perception.

Coded light can be used for a number of applications. For example, the data embedded in the light may comprise an identifier of the light source emitting that light. This identifier can then be used in a commissioning phase to identify the contribution from each luminaire, or during operation can be used to identify a luminaire in order to control it remotely (e.g. via an RF back channel). In another example, the identification can be used for navigation or other location-based functionality, by providing a mapping between the identifier and a known location of the light source, and/or other information associated with the location. In this case a mobile device such as a mobile phone or tablet receiving the light (e.g. through a built-in camera) can detect the embedded identifier and use it to look up the corresponding location and/or other information mapped to the identifier (e.g. in a location database accessed over a network such as the Internet). In yet further applications, other information can be directly encoded into the light (as opposed to being looked up based on an ID embedded in the light).

In order to operate, a light source is connected to a module called a driver, which is responsible for supplying power to the light source so as to generate a light output at the required level, and also for modulating the output so as to encode data into the light in the case of coded light. Typically the driver is incorporated into the same luminaire unit as the light source itself. For example in the case of an LED-based luminaire, LEDs placed on a printed circuit board may be connected as a load to an LED driver, and the LEDs thereby generate the required light level as well as transmit one or more coded light messages generated by the LED driver (e.g. based on a data signal generated by software run on a microcontroller).

An LED driver typically consists of one or more switch-mode converters, such as a buck converter. This (output) converter directly connected to the LED load is used to modulate LED current for coded light. There are different ways to modulate LED current, and therefore light intensity. Known techniques for modulating data into the light include pulse width modulation (PWM), and frequency modulation. PWM is performed at a fixed frequency, with discrete duty cycle levels corresponding to the logical levels in the coded light message. In frequency modulation on the other hand, discrete frequency levels correspond to the logical levels in the coded light messages. Another coded light modulation technique is amplitude modulation (AM), where the discrete amplitude levels correspond to the logical levels in the coded light messages.

SUMMARY OF THE INVENTION

According to one aspect disclosed herein there is provided a circuit for driving a load, the circuit comprising output circuitry for connecting the circuit to the load, switching circuitry arranged to supply power from a power supply to the load, and control circuitry. The output circuitry comprises one or more energy-storing components. The switching circuitry is arranged to supply power from the power supply to the load by supplying a current through at least one of the energy-storing components of the output circuitry that resists a change in current, or applying a voltage across at least one of the energy-storing components of the output circuitry that resists a change in voltage. The control circuitry is arranged to control the switching circuitry, to cause said current or voltage to oscillate between an upper envelope and a lower envelope. Further, the control circuitry is configured to modulate data into said current or voltage by shifting the upper envelope between at least a first amplitude level and a second amplitude level, and by shifting the lower envelope by the same amount in the same direction at the same time.

As will be exemplified in more detail below in the Detailed Description section, this shifting of the upper and lower envelopes together advantageously allows the switching frequency to stay constant when applying amplitude modulation. Furthermore, the amplitude steps applied to both envelopes can be halved compared to stepping only a single one of the envelopes, which causes less stress in magnetics and other components.

Preferably, the upper envelope is above zero for each of said levels, and the lower envelope is below zero for each of said levels. This advantageously allows for zero-voltage switching (e.g. quasi-resonant zero voltage switching).

The one or more energy-storing components may comprise at least an inductor, with the switching circuitry being arranged to supply power to the load by supplying said current through the inductor, and the control circuitry being arranged to cause said current to oscillate between the upper and lower envelope and to modulate the data into said current by said shifting of the upper and lower envelopes. In embodiments, the one or more energy-storing components may comprise the inductor and a capacitor arranged together in a filter formation to smooth the current supplied to the load.

Alternatively, the one or more energy-storing components may comprise at least a capacitor, with the switching circuitry being arranged to supply power to the load by supplying said voltage across the capacitor, and the control circuitry being arranged to cause said voltage to oscillate between the upper and lower envelope and to modulate data into said voltage by said shifting of the upper and lower envelopes. In embodiments, the one or more energy-storing components may comprise the capacitor and an inductor arranged together in a filter formation to smooth the voltage applied across the load.

In embodiments, the control circuitry may comprise a first comparator and a second comparator, the first comparator being arranged to bound the oscillation to the upper envelope by comparing feedback of said current or voltage to an upper reference signal, and the second comparator being configured to bound the oscillation to the lower envelope by comparing feedback of said current or voltage to a lower reference signal.

In embodiments, said shifting of the upper and lower envelopes may be controlled by software. For example, the software may control the shifting by controlling the upper and lower reference signals.

In embodiments, the switching circuitry may comprise a high side switch for connecting the output circuitry to a higher voltage supply rail of said power supply, and a low side switch for connecting the output circuitry to a lower voltage supply rail of said power supply; the control circuitry being configured to cause the oscillation to ramp up towards the upper envelope by asserting the high side switch, and to cause the oscillation to ramp down to towards the lower envelope by asserting the low side switch.

In embodiments, the load may comprise a light source and the output circuitry is connected to drive the light source. For example, the light source may comprise at least one LED.

In embodiments, the circuit may take the form of a buck converter.

According to another aspect disclosed herein, there is provided a computer program product for controlling a driver circuit, the computer program product being stored on at least one computer-readable storage medium and/or downloadable via a computer network; wherein: the driver circuit is operable to supply power from a power supply to a load by supplying a current through at least one energy-storing component that resists a change in current, or applying a voltage across at least one energy-storing component that resists a change in voltage, and the driver circuit comprises control circuitry operable to cause said current or voltage to oscillate between an upper envelope and a lower envelope; and the computer program product comprises code configured so as, when executed on one or more processors, to control the control circuitry to modulate data into said current or voltage by shifting the upper envelope between at least a first amplitude level and a second amplitude level, and by shifting the lower envelope by the same amount in the same direction at the same time.

According to another aspect disclosed herein, there is provided a method of driving a load, the method comprising: supplying power from a power supply to the load via an output stage comprising one or more energy-storing components, by supplying a current through at least one of the energy-storing components of the output stage that resists a change in current, or applying a voltage across at least one of the energy-storing components of the output stage that resists a change in voltage; causing said current or voltage to oscillate between an upper envelope and a lower envelope; and modulating data into said current or voltage by shifting the upper envelope between at least a first amplitude level and a second amplitude level, and by shifting the lower envelope by the same amount in the same direction at the same time.

BRIEF DESCRIPTION OF THE DRAWINGS

To assist the understanding of the present disclosure and to show how embodiments may be put into effect, reference is made by way of example to the accompanying drawings in which.

DETAILED DESCRIPTION OF PREFERRED EMBODIMENTS

Figure 3:
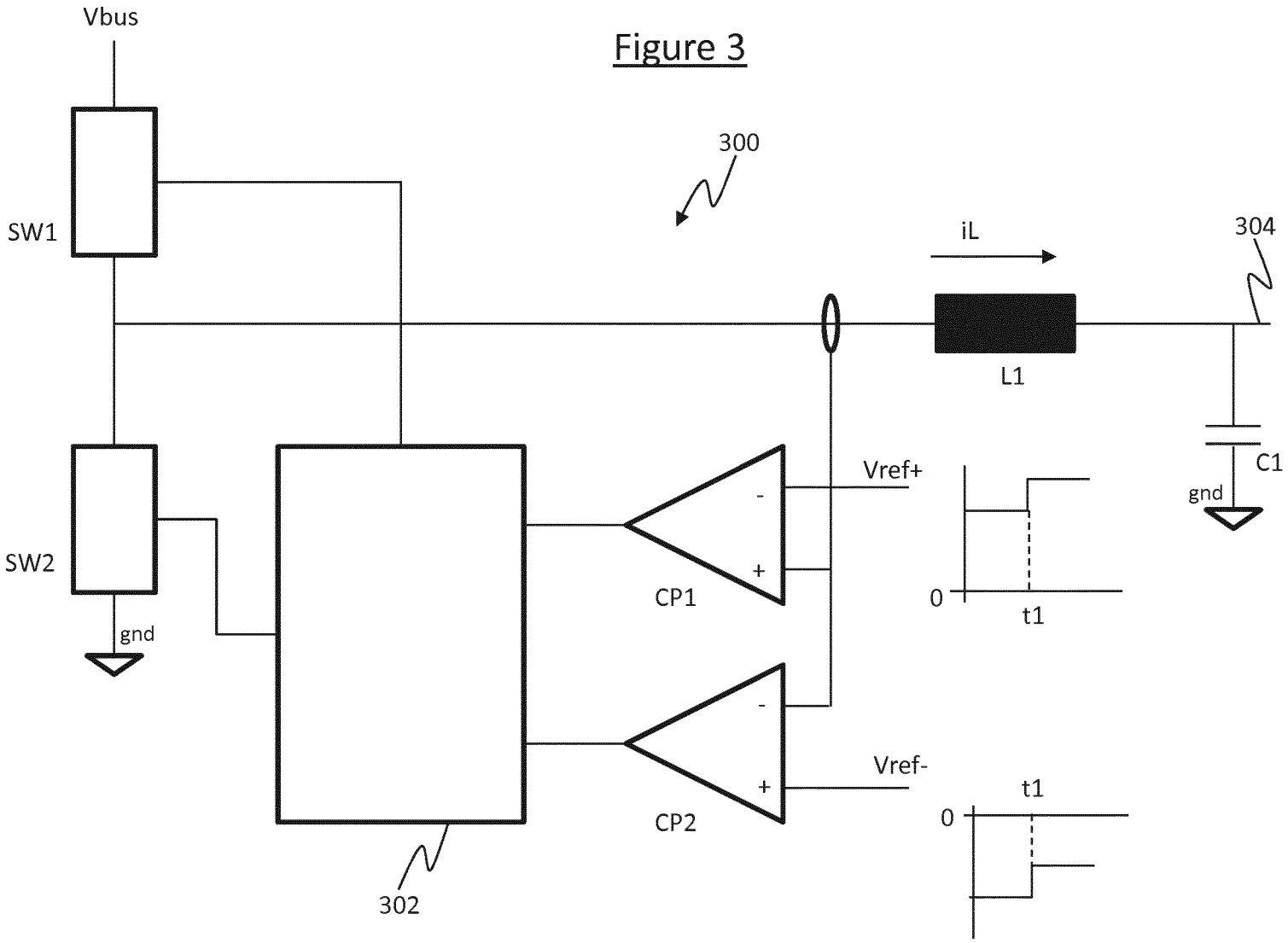
FIG. 3 is a schematic circuit diagram of a driver circuit for driving a load.
Figure 4:
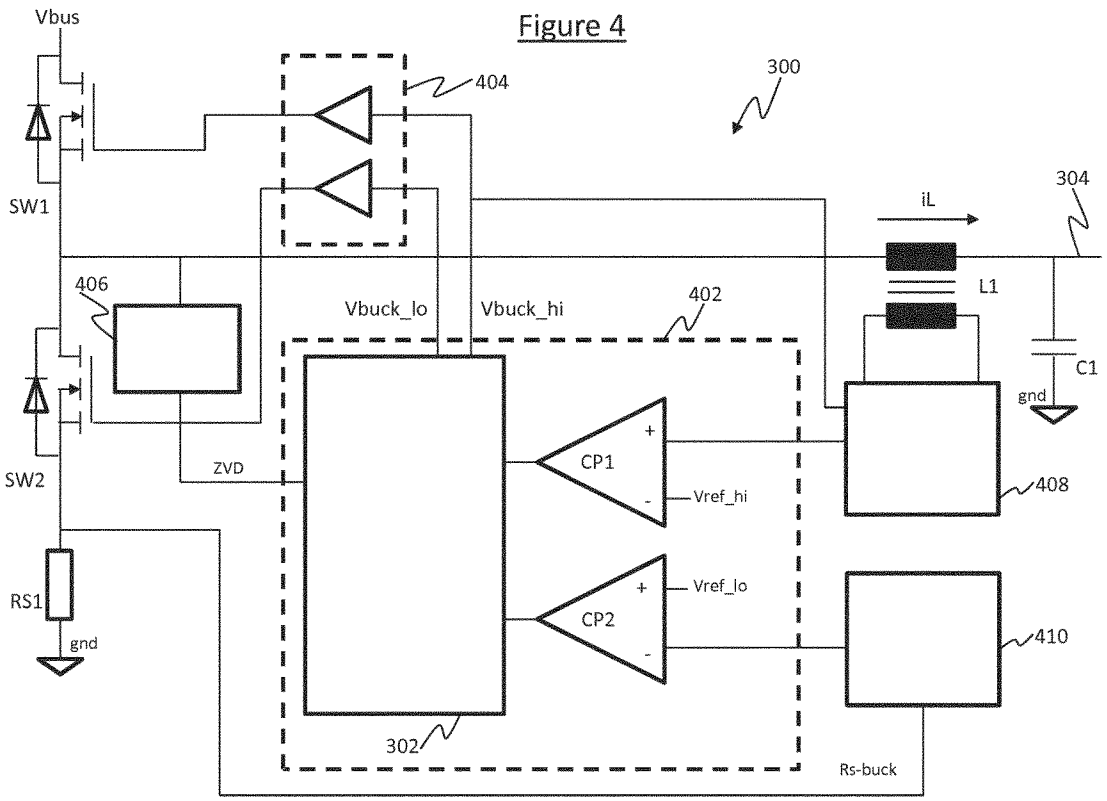
FIG. 4 is another schematic circuit diagram of a driver circuit for driving a load.

FIG. 4 shows an example of a driver circuit 300 in accordance with embodiments of the present disclosure, for driving an LED (or group of LEDs) to emit coded light. FIG. 3 is an equivalent diagram of the same circuit in simplified form. In the illustrated example, the circuit 300 takes the form of a synchronous, dual-switch buck converter similar and/or equivalent circuits may be found in the Xitanium 75 W LED driver, or indeed as may be used for other drivers. In embodiments, adding the disclosed coded light function to the Xitanium 75 W LED driver requires a firmware update only, similar to updates for smart phones or tablets. There is no need to change the hardware, and, as such, earlier installed LED drivers can also be upgraded with coded light capability. However, it will be appreciated this is just one example, and other implementations are possible, either in pure hardware or a combination of hardware and software such as firmware.

The circuit 300 comprises a first, high-side electronic switch (e.g. a MOSFET) SW1, a second, low-side electronic switch (e.g. another MOSFET) SW2, and a sensing resistor RS1 connected in series between an upper supply rail and a lower supply rail of a power supply, in this case a between positive voltage Vbus and ground respectively (but it will be appreciated that other arrangements of supply rails are possible, e.g. positive and negative supply rails). Each switch SW1 and SW2 has a first conducting terminal, a second conducting terminal and a switching terminal for controlling whether current can flow between the first and second conducting terminals (e.g. in the case of an N-channel MOSFET as illustrated, these are the drain, source and gate respectively). The high side switch SW1 has its first conducting terminal connected to the upper supply rail Vbus, and its second conducting terminal connected to the first conducting terminal of the low-side switch SW2. The low-side switch SW2 has its second conducting terminal connected to a first terminal of the sensing resistor RS1, and the other terminal of the sensing resistor RS1 is connected to the lower supply rail (in this example to ground). Thus there is formed a juncture between the high-side switch SW1 and the low-side switch SW2 (i.e. the wire connecting the second conducting terminal of the high-side switch SW1 and the first conducting terminal of the low-side switch SW2), and a further juncture between the low-side switch SW2 and the sensing resistor RS1 (i.e. the wire connecting the second conducting terminal of the low-side switch SW2 to the first terminal of the sensing resistor RS1).

The circuit 300 also comprises an output stage comprising a plurality of energy-storing components, in this case an inductor L1 and a capacitor C1. The juncture between the high-side switch SW1 and the low-side switch SW2 is connected a first terminal of the inductor L1, and the other terminal of the inductor L1 is connected to an output line 304 which is the connection to the load 704 (see also FIG. 7, described shortly). Thus the switching circuitry SW1, SW2 is operable to connect the load 704, via the inductor L1, either to the upper supply rail Vbus or to the lower supply rail (in this case ground). N.B. as will be discussed in more detail later, the high- and low-side switches SW1 and SW2 are switched on alternately such that when one is off the other is on, and vice versa.

The output line 304 is also connected to a first terminal of the capacitor C1, and the other terminal of the capacitor C1 is connected to the lower supply rail (e.g. ground), thus forming a filter with the inductor L1 in the output stage.

The circuit 300 further comprises a cycle-by-cycle controller 302, which has a first output connected to control the switching terminal of the high-side switch SW1 with a first switching signal Vbuck_hi, and a second output connected to control the switching terminal of the low-side switch SW2 with a second switching signal Vbuck_lo. In embodiments both these connections are via a buffer 404, e.g. a FAN7380. The cycle-by-cycle controller 302 may also have a third output connected to the input of a Zero Voltage Detection (ZVD) circuit 406, with the output of the ZVD circuit connected to the juncture between the high-side switch SW1 and the low-side switch SW2. The ZVD circuit 406 is a measurement/sense circuit embodied in hardware which detects if the voltage across either of the switches SW1 and SW2 is zero or close to zero.

In practice, the ZVD output signal will typically be a scaled down copy of the ZVD circuit input voltage. The scaling is needed for cycle-by-cycle controller 302 which can only handle certain voltage (e.g. 5V) levels, while the input to the ZVD circuit which is connected to the drain of SW2/source of SW1 is ramping up and down between Vbus (typically at least 400V with respect to gnd) and gnd.

In addition, the circuit 300 comprises a first comparator CP1 and a second comparator CP2, with the output of the first comparator CP1 being connected to a first input of the cycle-by-cycle controller 302, and the output of the second comparator CP2 being connected to a second input of the cycle-by-cycle controller 302. Each of the comparators CP1 and CP2 comprises first input and a second input for comparison with the first input, e.g. an inverting input (−) and a non-inverting input (+) respectively. The circuit 300 comprises a PCD ("Positive (peak) Current Detection") circuit 408 connected to obtain feedback of the current iL flowing through the inductor L1 when connected by the high-side switch SW1 to the upper supply rail Vbus, and a NCD ("Negative (peak) Current Detection") circuit 410 connected to obtain feedback of the current iL flowing through the inductor L1 when connected by the low-side switch SW2 to the lower supply rail (here ground). In embodiments, the PCD circuit 408 is connected to use the voltage from a secondary winding on the inductor L1 to integrate and thereby reconstruct the inductor current iL when the high-side switch SW1 is conducting, whereas the NCD circuit 410 is connected to the juncture between the low-side switch SW2 and the sensing resistor RS1 so as to measure the inductor current iL by measuring the current through the sensing resistor RS1 when the low-side switch SW2 is conducting. However, it will be appreciated that other arrangements are possible for obtaining the feedback.

For example, the PCD 408 circuit might be extended to also include detection of the negative peak current as well, making the NCD circuit 410 in that case obsolete. The PCD circuit 408 would keep the same secondary winding voltage as input for reconstructing inductor current, but would have two outputs, one going to CP1 and the other connected to CP2. However, in the preferred implementation, the PCD and NCD circuits are separate solutions based on two different input sources for detection, i.e. secondary winding voltage from inductor L1 for PCD and voltage across sense resistor RS1 for NCD.

The PCD circuit 408 is connected to supply its feedback of the inductor current iL to one of the inputs of the first comparator CP1, e.g. the non-inverting input. The other input of the first comparator CP1, e.g. the inverting input, is connected to receive an upper reference signal Vref_hi. The NCD circuit 410 is connected to supply its feedback of the inductor current iL to one of the inputs of the second comparator CP2, e.g. the inverting input. The other input of the second comparator CP2, e.g. the non-inverting input, is connected to receive a lower reference signal Vref_lo. In embodiments, the first and second comparators CP1, CP2 are connected to receive the upper and lower reference signals Vref_hi, Vref_lo respectively from software run on a processor such as a microprocessor. In embodiments, the cycle-by-cycle controller 302 and comparators CP1, CP2 are integrated on the same microcontroller unit (MCU) 402 that runs the software for generating the upper and lower reference signals Vref_hi and Vref_lo. However, this does not have to be the case in all possible embodiments, e.g. Vref_hi and Vref_lo could be generated by one or more processors separate from the cycle-by-cycle controller 302 and/or comparators CP1, CP2; or the Vref_hi and Vref_lo could even be generated by dedicated hardware circuitry, or configurable or reconfigurable circuitry such as a PGA or FPGA.

Figure 7:
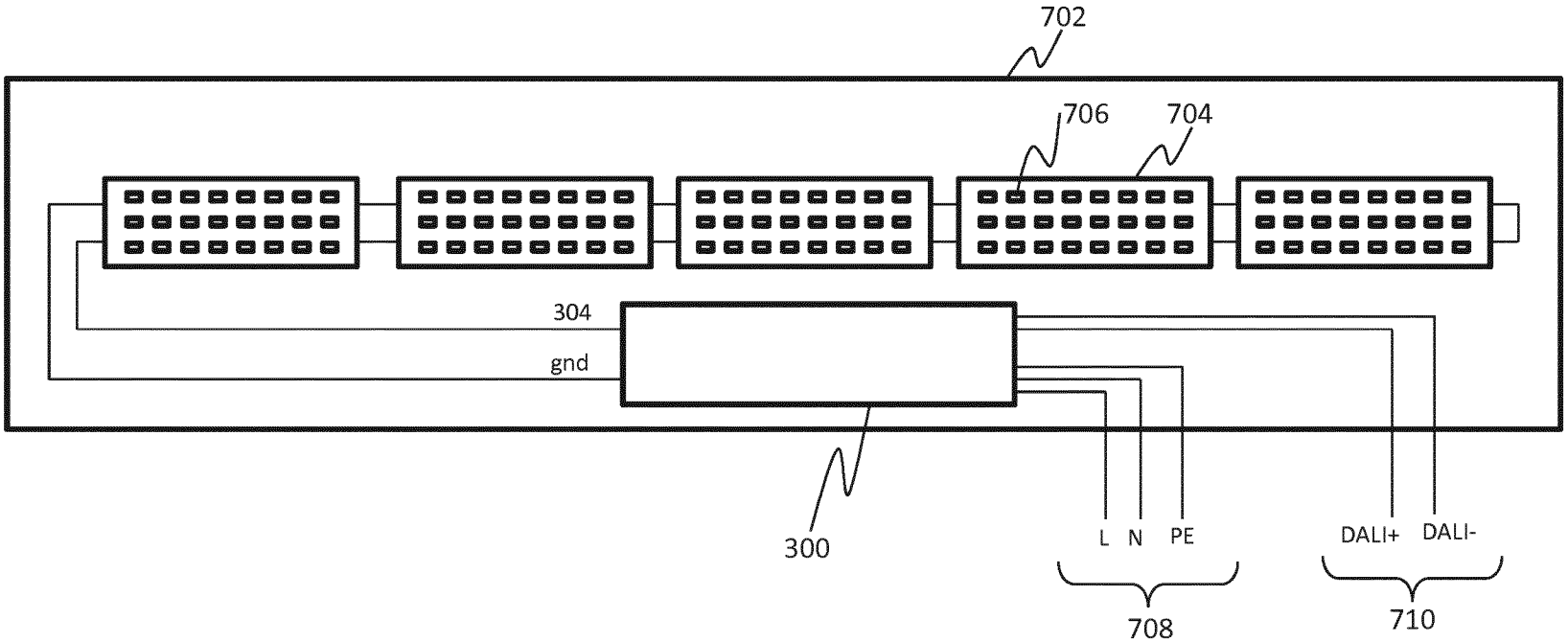
FIG. 7 is a schematic block diagram of a luminaire.

FIG. 7 shows the circuit 300 of FIGS. 3 and 4 in context. Here the circuit 300 is integrated in a luminaire 702. Such a luminaire 702 typically comprises: one or more LED boards 704 each comprising one or more LEDs 706, and at least one LED driver 300 connected to drive the LEDs 706 of the one or more LED boards 704; along with any optics plates and/or other optical materials or devices for directing and/or shaping the light emitted from the LEDs 706, and a metal frame or other frame or housing structure for supporting the driver 300, LED boards 704 and optics. The driver circuit 300 is arranged to receive its power supply via supply leads 708, and to receive the data to be modulated into the light (as well as any other data such as a dim level) via a digital interface 710.

In accordance with embodiments of the present disclosure, the LED driver 300 is configured for coded light (in embodiments by a software upgrade only), and of course also to drive the LED panels 704 connected to its output at the user requested (dim) level. In case of coded light, the LED current will be modulated (in this case with amplitude modulation), therefore modulating the emitted light.

Figure 1A:
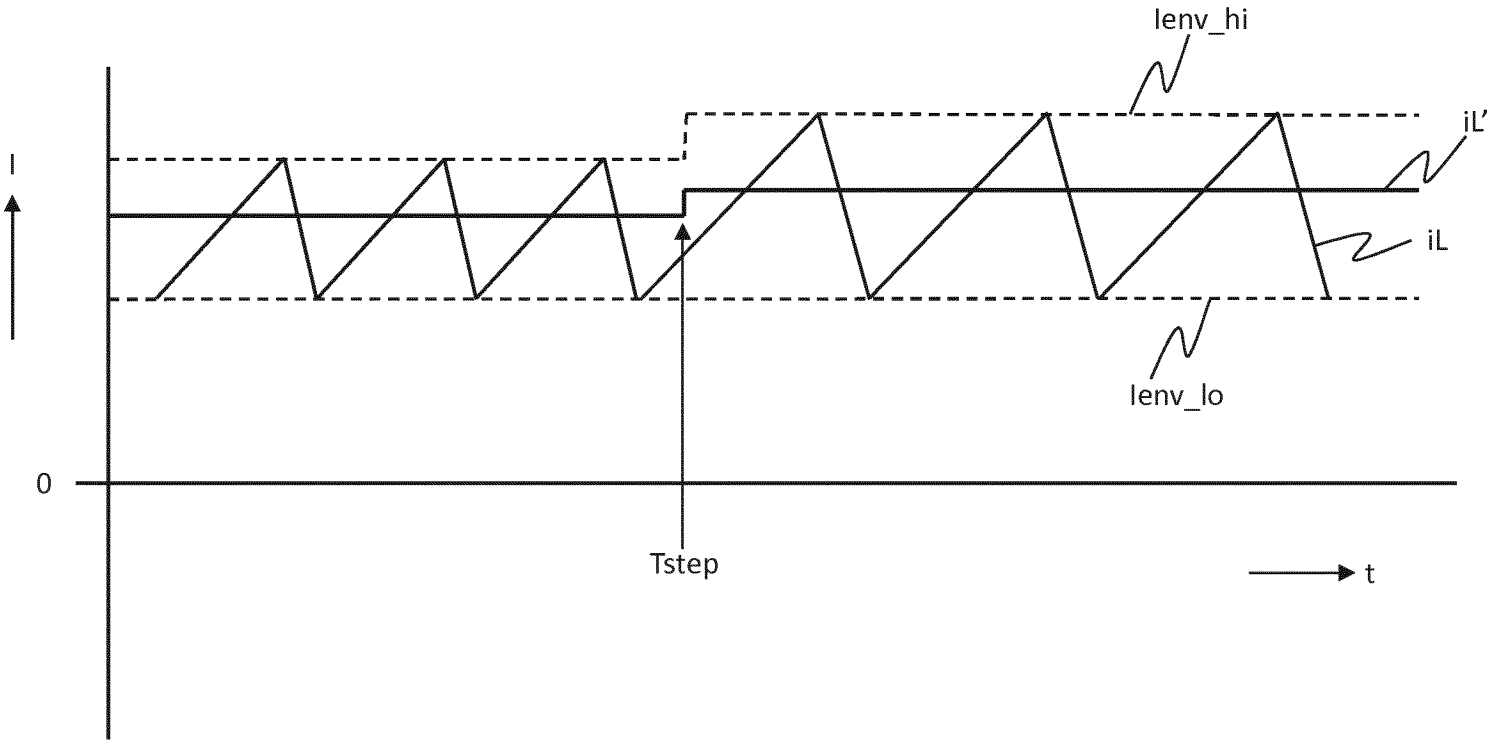
FIG. 1*a* is a schematic sketch of a graph showing current supplied to a load.
Figure 1B:
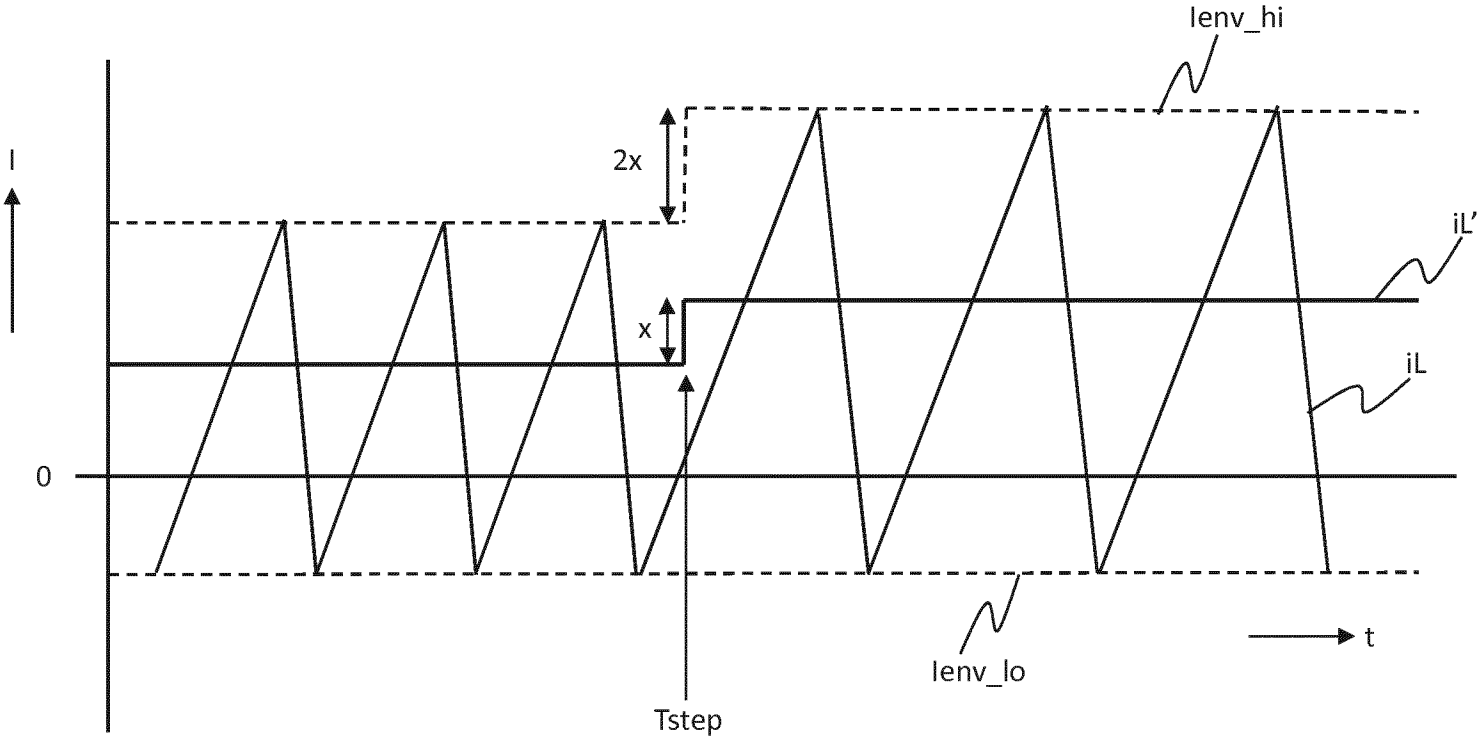
FIG. 1*b* is another a schematic sketch of a graph showing current supplied to a load.
Figure 2:
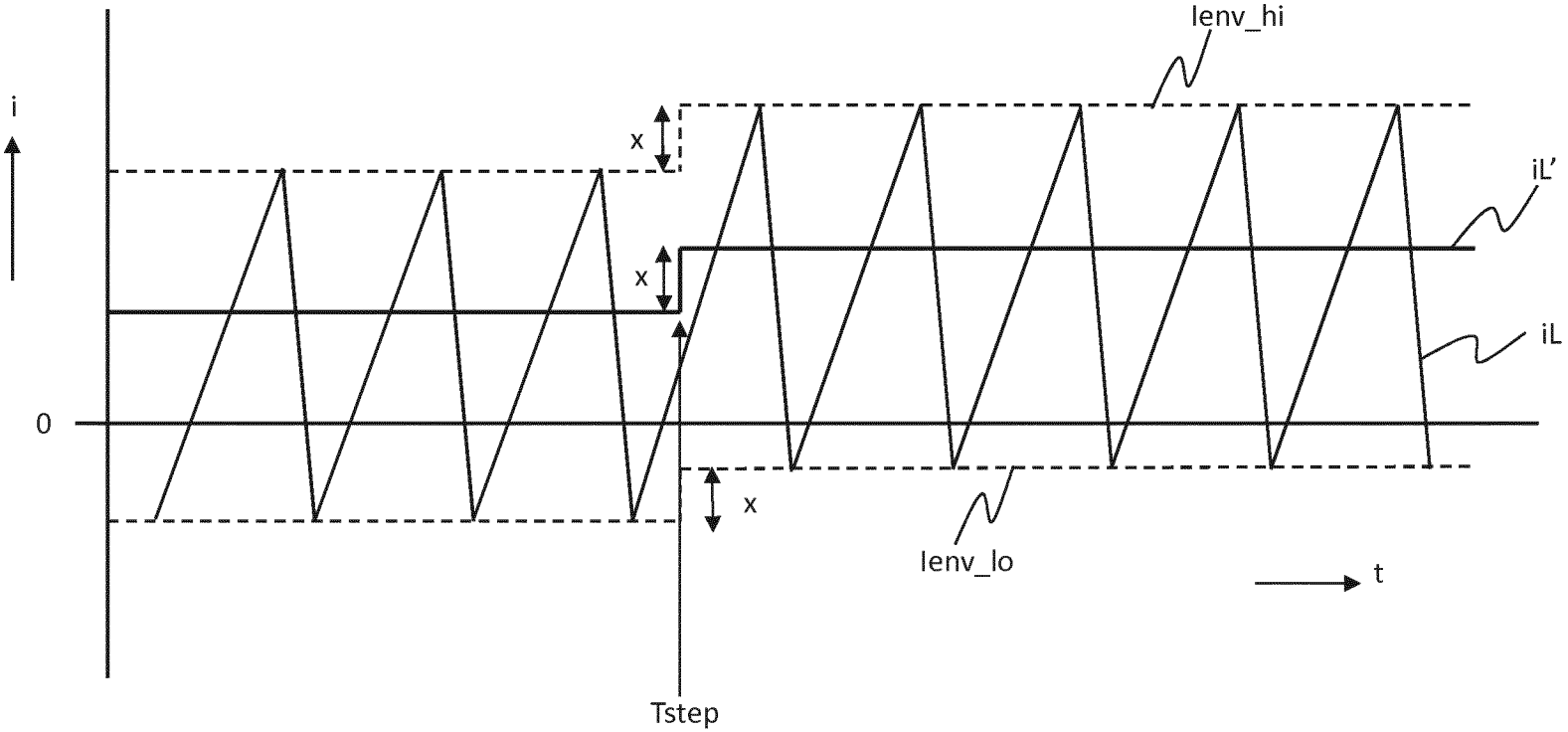
FIG. 2 is another schematic sketch of a graph showing current supplied to a load.

Operation of the circuit 300 is discussed in relation to FIGS. 1*a*, 1*b* and 2. For the purpose of illustration, consider that the cycle-by-cycle controller 302 begins with Vbuck_hi set to a logic-high level and Vbuck_lo set to a logic-low level. This means the high-side switch SW1 will be turned on (conducting) and the low-side switch SW2 will be turned off (not conducting). Thus the inductor L1 is connected to the upper supply rail Vbus, and current begins to ramp up (increase) in the inductor L1 in the direction from the upper supply rail Vbus to the load 704. While this is happening, the first comparator CP1 compares the feedback of this current (received via the PCD circuit 408) to the upper reference signal Vref_hi (e.g. supplied by software). N.B. the feedback may be a voltage signal representative of the current iL. The result of the comparison is output from the first comparator CP1 to the cycle-by-cycle controller 302. At time Tstep, when the feedback reaches the level of the upper reference signal Vref_hi, corresponding to an upper envelope (upper bound) Ienv_hi to be applied to the inductor current iL, then the cycle-by-cycle controller 302 sets Vbuck_hi to a logic-low and sets Vbuck_lo to a logic-high. This means the high-side switch SW1 will now be turned off (not conducting) and the low-side switch SW2 will be turned on (conducting). Thus the inductor L1 is now connected to the lower supply rail (e.g. ground), and current begins to ramp down (decrease) in the inductor L1 (in the case of FIGS. 1*b* and 2, eventually reversing to flow in the direction from the load 704 to the lower supply rail). While this is happening, the second comparator CP2 compares the feedback of this current (received via the NCD circuit 410) to the lower reference signal Vref_lo (e.g. supplied by software). The result of the comparison is output from the second comparator CP2 to the cycle-by-cycle controller 302. Once the feedback reaches the level of the lower reference signal Vref_lo, corresponding to a lower envelope (lower bound) Ienv_lo to be applied to the inductor current iL, then the cycle-by-cycle controller 302 sets Vbuck_hi back to logic-high and sets Vbuck_lo back to logic-low. Thus the process repeats in a cycle, with the current iL in the inductor iL oscillating between the upper and lower envelope levels Ienv_hi and Ienv_lo.

In embodiments, the detection of inductor current iL is split into two circuits, one for detecting the positive (PCD circuit 408) and one for detecting the negative peak inductor current (NCD circuit 410). A description of the two circuits follows below.

The PCD circuit 408 uses the voltage from a secondary winding on the inductor L1 to integrate and reconstruct the inductor current at times that switch SW1 is conducting. The drive signal Vbuck_hi from the MCU 402 is used to properly reset the integrating circuit element, a capacitor, before starting a next integration cycle. When the measured peak current exceeds the positive peak current reference, the high side switch SW1 is turned off. As will be discussed further below, steps are superimposed on top of the positive peak current reference in order to achieve coded light. The positive peak inductor current and thus the LED current, and therefore the emitted light level, will follow these steps.

The NCD circuit 410 uses information from the sense resistor RS1 in series with switch SW2 to reconstruct and measure the negative current at times that switch SW2 is conducting. The measured current is compared to a negative peak current reference level and when exceeding the lower peak, switch SW2 is turned off. Similar to the positive peak reference, current steps for coded light are applied to this reference; and so the negative peak inductor current, and thus LED current and therefore light level, will follow.

The circuit 300 may be described as a "hysteretic" buck. Hysteresis is the property of a circuit whereby the output is not only dependent on the circuit's present input, but also on its history of past inputs (in this case due to the energy-storing components L1 and C1). The name "hysteretic" buck refers to the hysteresis behavior of inductor current which ramps up and down between two predetermined levels, here the reference levels for positive and negative peak inductor current.

The cycling of inductor current between the upper and lower reference current levels means that disturbances on Vbus which might be present do not impact the cycling amplitude as such (because that is dictated by upper and lower reference values), and therefore the average (output) current, i.e. LED current, is not effected by the disturbances on Vbus, although the cycle/switching frequency can/will be effected. So the rejection ratio of Vbus disturbances to LED current of a hysteretic buck is very good.

In embodiments, the inductor L1 is connected with a capacitor C1 in parallel with the load 704, thus forming a filter so that the current is supplied to the load 704 in a smoothed form iL' which approximately equals a DC current. Alternatively or additionally, another filter circuit (not shown) could be connected between the output line 304 and the load 704.

Note also, although not drawn in FIGS. 3 and 4, in embodiments there may also be provided another, outer feedback loop which is responsible for controlling the LED current (average inductor current).

For the purpose of coded light, modulation is achieved by controlling the positive and/or negative peak inductor currents Ienv_hi and Ienv_lo of the buck converter, through coding the reference levels Vref_hi and Vref_lo of the (window) comparators CP1 and CP2 (e.g. controlled by software).

One way to do this would be to keep the lower envelope Ienv_lo at a constant, positive level (by holding Vref_lo constant); and to modulate only the upper envelope Ienv_hi (by controlling Vref_hi) to represent the data. E.g. a higher envelope represents a logic-1 in the data and a lower envelope represents a logic-0 (or vice versa, or more generally other symbols for representing data could modulated into the envelope in a similar fashion). This is illustrated in FIG. 1*a*. However, there are a number of issues with this technique.

Firstly, in embodiments it may be preferable to be able to exploit zero-voltage switching (ZVS), preferably quasi-resonant ZVS (QR-ZVS). For the present purposes, zero voltage switching means turning on a switch device (typically a MOSFET) only at the moment when the voltage (drain-source voltage in the case of a MOSFET) across this switch device equals zero. So in the example of FIGS. 3 and 4, this means switching SW1 and SW2 at the moment when the source-drain voltage is zero.

To achieve this, the preferred operation mode of the hysteretic buck is a boundary mode of operation, i.e. the inductor current iL goes negative to create zero switching conditions for the high side (MOSFET) switch SW1. This is illustrated in FIG. 1*b*. As can be seen, the lower envelope Ienv_lo is now kept negative throughout (unlike in FIG. 1*a*). Zero voltage switching is desirable because switching losses can be substantial when not switching under zero voltage conditions from a high bus voltage Vbus (e.g. in embodiments about 400-500V). The switches SW1 and SW2 are controlled by the cycle-by-cycle controller 302 which generates the correct drive signals for both switches so as to operate the buck in the boundary conduction mode (critical conduction mode) at all times, i.e. creating zero-voltage switching conditions to minimize losses. E.g. the cycle-by-cycle controller 302 may comprise PWM generators which can handle at least the events from the comparators CP1, CP2 along with some more signals (not drawn in FIG. 4) to guarantee boundary/critical operation mode.

However, there are still one or more issues to be addressed even with the modulation disclosed in relation to FIG. 1*b*.

Particularly, when only the positive peak current Ienv_hi is modulated, the result is that the switching frequency (the frequency of oscillation back and forth between the upper and lower envelopes Ienv_hi and Ienv_lo) is different for the different logical levels, e.g. different for 0s than for 1s. Changes in the switching frequency have a negative impact on the quality of light (ripple in the LED current) and should therefore be avoided.

Furthermore, to achieve a certain step x in the LED current (e.g. 10%) for the purpose of coded light, a 2× change in amplitude is needed (e.g. 20%), which significantly increases the stresses in the inductor. Refer again to FIG. 1*b*.

As shown in FIG. 2, embodiments of the present disclosure provide a solution to one or both of these problems, by modulating both the references for the positive peak inductor current Ienv_hi and the negative peak inductor current Ienv_lo by the same amount in the same direction at the same moment (Tstep). In this case, the switching frequency is always kept the same, so the switching ripple in LED current will not change. Thus the quality of light and the quality of coded light is improved compared to the situation where only one of the two references are modulated.

Furthermore, when both reference levels are changed by an amount x (e.g. 10%) for coded light purposes, then the average inductor current and therefore LED current also only changes by x (e.g. also 10%), thus limiting the stresses in the inductor L1. That is, to achieve a certain step x in the LED current (e.g. 10%), only a change of x is required in the amplitude, not 2x.

In this way, hysteretic control is achieved which yields very good control over average output current, i.e. LED current, and thus light.

As mentioned, the hardware of the Xitanium 75 W LED driver allowed the adaptation of device functionality by means of a software-only update, thereby adding coded light functionality in accordance with the invention to the existing functions of the LED driver. At time Tstep, both reference levels Ienv_hi and Ienv_lo are stepped up with equal amplitude, thus leading to an equivalent step up in the amplitude of the average LED current (to a level above the overall average required for the presently set LED dim level). Steps down are achieved in similar way by setting the reference levels for both positive and negative peak current are stepped down, thus leading to an equivalent step down in the amplitude of the average LED current (to a level lower than the overall average required for the presently set LED dim level). Note that LED current corresponds to light intensity level, and that coded light is also active at dimmed levels.

The coded light amplitude steps are timed at equidistant, fixed intervals and may be integrated in the already existing task scheduler of the LED driver. Example: to achieve a coded Light symbol rate of 2 kHz, an update of reference levels every 500 μs is required, which fits the 250 μs (4 kHz) scheduler of the LED driver: every second tick a next level in coded light is set.

Figure 5:
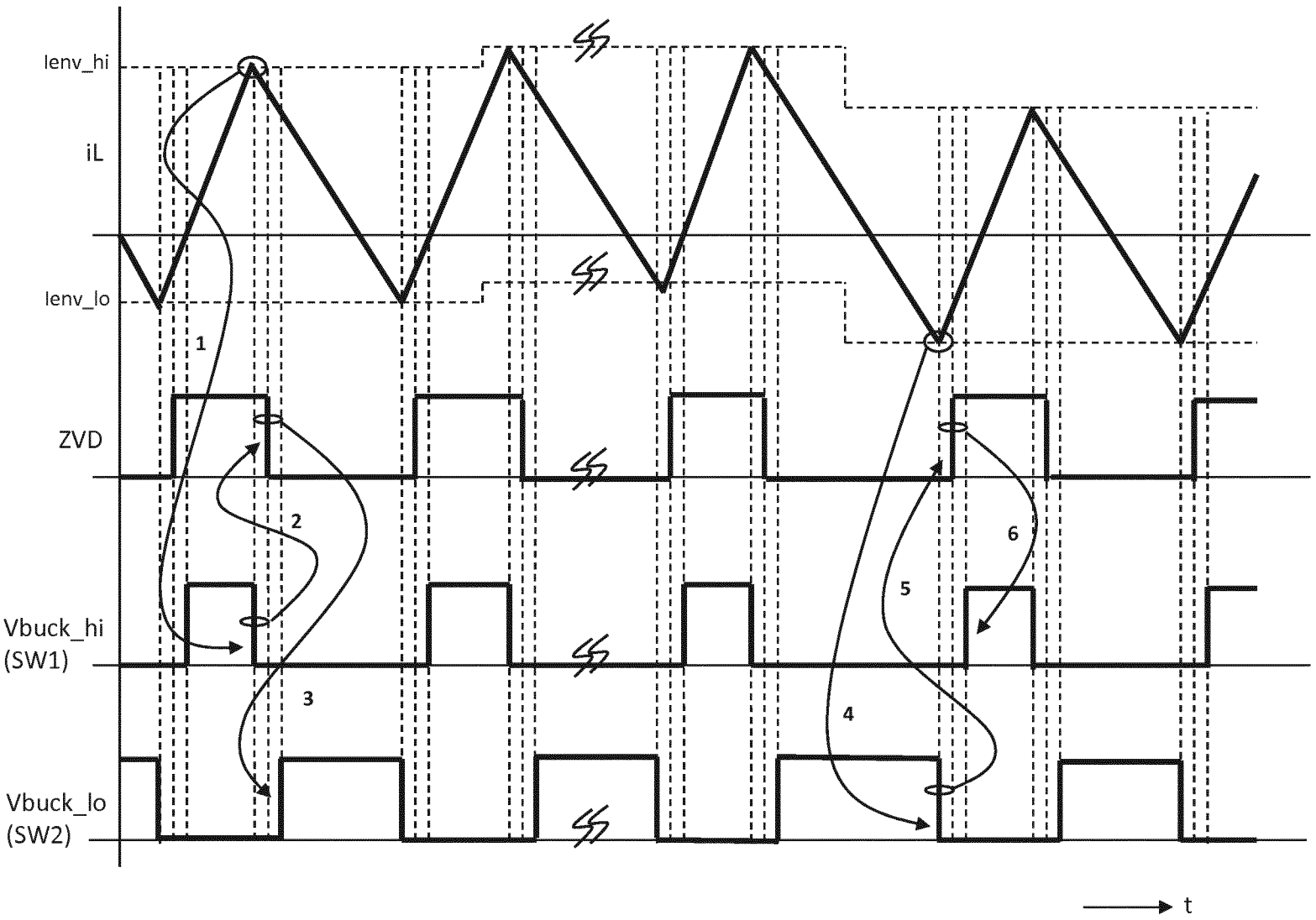
FIG. 5 is a schematic timing diagram showing the timing of current supplied to a load relative to voltages in a driver circuit.
Figure 6:
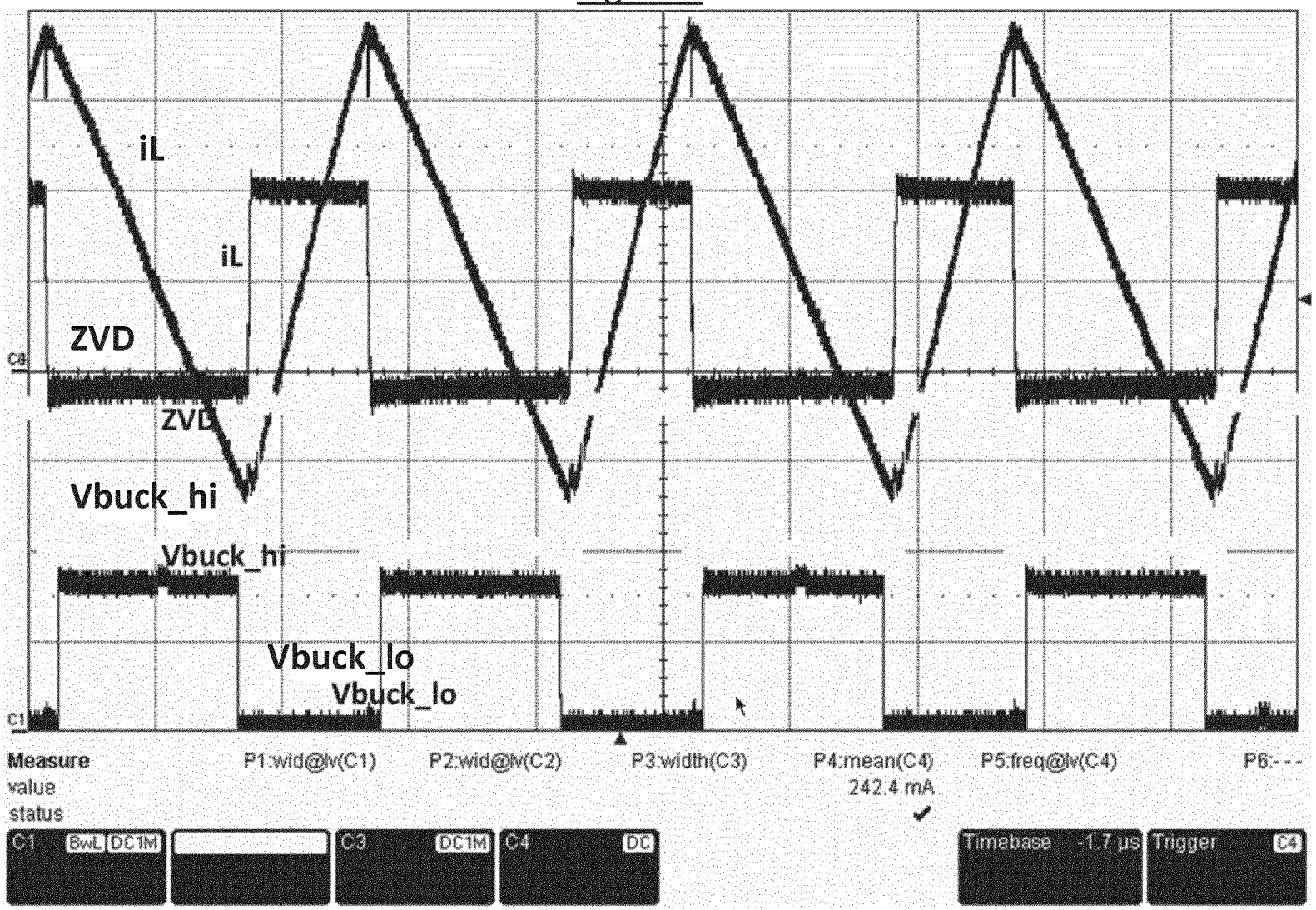
FIG. 6 is an oscilloscope trace of showing the timing of current supplied to a load relative to voltages in a driver circuit.

FIG. 5 shows a timing diagram of the sync buck, including signals iL, ZVD, Vbuck_hi and Vbuck_lo. FIG. 6 shows real-world measurements of the same signals as FIG. 5.

Referring to the labelling in FIG. 5, events 1 to 3 show the turn-off of SW1 to turn-on of SW2 sequence:

at reaching the positive peak reference current, SW1 is turned off, i.e. Vbuck_hi goes low;

as a result, the drain voltage on SW2 (=source voltage on SW1) drops and therefore ZVD (which is a scaled value of drain voltage) drops to zero after some time;

the falling edge of ZVD is detected and SW2 is turned on (Lo-buck goes high).

In the same manner, events 4 to 6 show the turn-off of SW2 to turn-on of SW1 sequence:

at reaching the negative peak reference current, SW2 is turned off, i.e. Lo-buck goes low;

as a result, ZVD rises up to the supply voltage of e.g. 5V;

the rising edge of ZVD is detected and SW1 is turned on (Hi-buck goes high).

These sequences are maintained when positive and negative peak current levels are modulated for coded light messages.

A description of zero-voltage switching is now given in relation to FIGS. 8*a* to 8*d*.

Zero Voltage Switching (ZVS) in the present case means turning on a switch device (typically a MOSFET) only at the moment when the voltage (drain-source voltage of the MOSFET) across this switch device equals zero. Quasi-resonant ZVS refers to a way in which ZVS is achieved: resonant energy is used during the moments of switching to create zero voltages across the device before turning it on. The resonant elements consist of inductor L1 and parasitic capacitances Cpar1 and Cpar2 present across the switch devices. Resonance occurs when both switches SW1 and SW2 are off, i.e. not conducting (inductor) current.

In practice, ZVS basically means: first the intrinsic body diode (forward voltage drop) of the MOSFET is conducting the (inductor) current, then the channel (lower voltage drop, Rdson) is conducting the current by applying gate-source voltage and, as a result, turning on the device.

In case of the sync buck, the lower switch SW2 is kept closed for some time longer, set by the negative peak current reference level to store additional resonant energy in the inductor not contributing to output current only to create ZVS conditions for switch SW1.

In fact, ZVS conditions for switch SW1 need only be created when the voltage across output capacitor C1 (VC1) is smaller than half the bus voltage Vbus; that is, additional energy in the inductor is only needed for switch SW1 to achieve ZVS if VC1<0.5*Vbus. Typical LED loads connected to the output of the buck converter do indeed have load voltages VC1 smaller than half the bus voltage Vbus, hence the introduction of the sync buck.

Figure 8A:
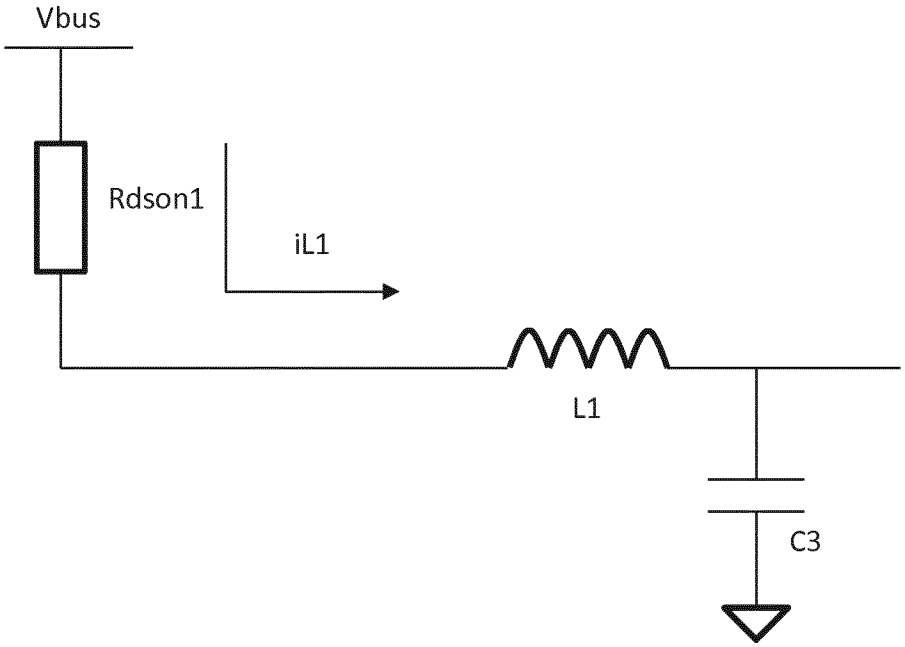
FIGS. 8*a* to 8*d* are schematic diagrams showing circuitry involved in quasi-resonant zero voltage switching.
Figure 8B:
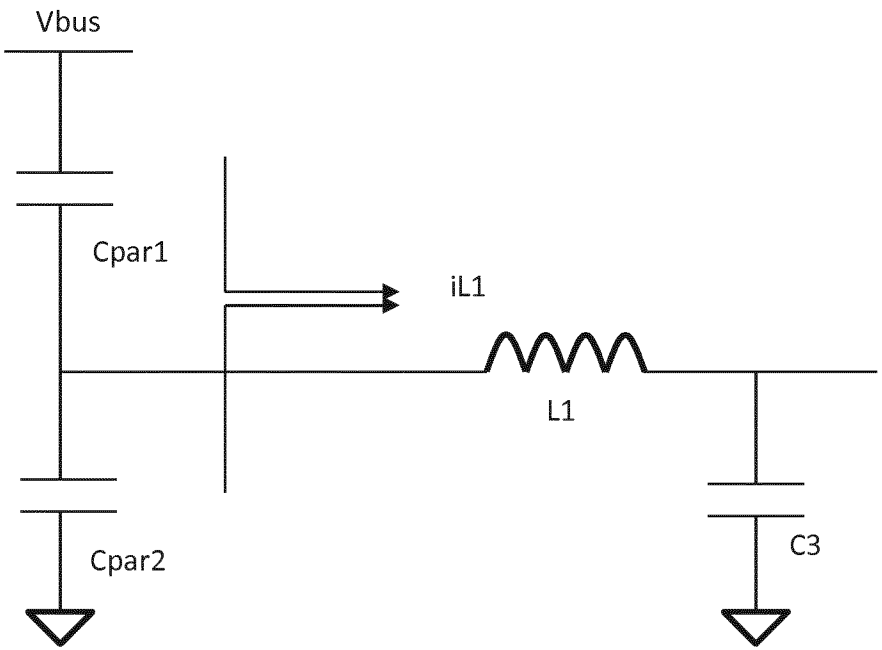
Figure 8C:
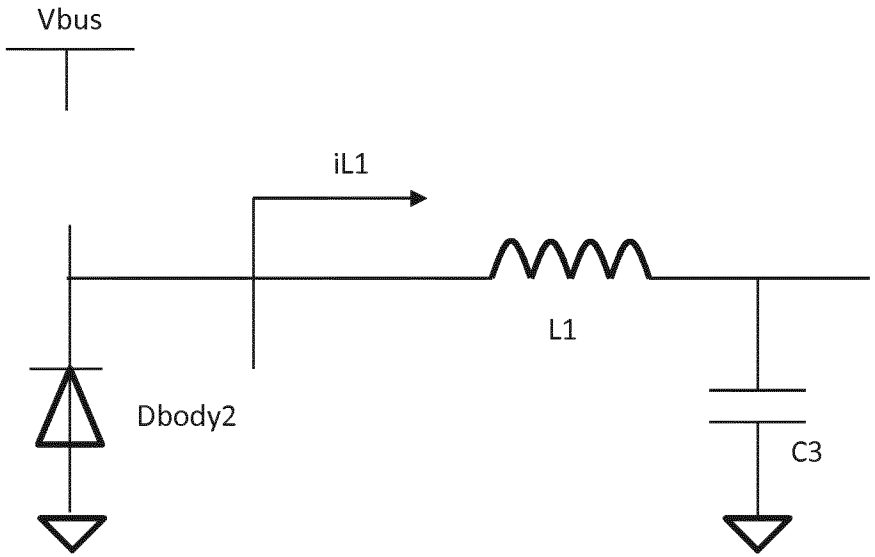
Figure 8D:
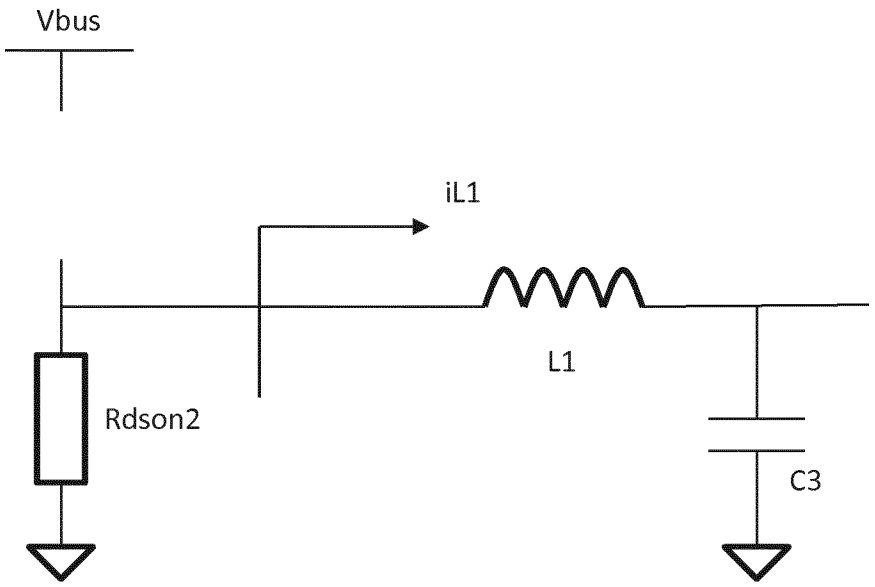

FIG. 8*a* shows the part of the cycle in which SW1 is conducting. FIG. 8*b* shows the part of the cycle in which SW1 is turned off when iL1 reaches positive peak reference level. What's left are parasitics Cpar1 and Cpar2 which are (dis)charged. ZVD (drain voltage of SW2) drops. See FIG. 5, events 1 and 2. FIG. 8*c* shows the part of the cycle in which ZVD (drain voltage of switch SW2) has reached zero (actually about −0.7V), and the intrinsic body diode Dbody2 of SW2 is now conducting inductor current. See FIG. 5, in between event 2 and 3. FIG. 8*d* shows the part of the cycle in which, at the same time after the body diode is conducting the current in switch device SW2 (MOSFET 2), the MOSFET is turned on and the channel is now conducting the current. See FIG. 5, event 3.

(QR-)ZVS has the advantages of minimized (turn-on) losses and therefore temperature in the device; and reduced electromagnetic interference (EMI), because high dv/dt values due to (hard-)switching are avoided.

It will be appreciated that the above embodiments have been described by way of example only.

For instance, while preferred, it is not essential to use zero-voltage switching, and therefore not essential in all possible embodiments that the lower envelope Ienv_lo is below zero. Other modes of device switching are also possible, such as valley switching or hard-switching, with reduced switching losses.

Generally, the techniques disclosed herein are applicable to other buck converters, other switch-mode converters, or more generally other driver circuits. E.g. different switch-mode converters can be operated via hysteretic control. Hysteretic control could be used in any type of driver which incorporates energy storage components, like inductors and capacitors. As such, hysteretic control can be performed on (inductor) current or (capacitor) voltage. In case of the buck converter, it is the peak-to-peak buck inductor current that is controlled (as in the example given above). In the case of a half-bridge (HB) resonant load type of converter which is used in other Xitanium LED drivers for example, the peak-to-peak voltage on a resonant capacitor can be controlled (Von-Voff control). The principle behind the operation of the device would be similar, and the basic hardware components would be common to the different implementations: two comparators, two peak reference levels, and some control logic.

Note also, where it is said herein that the upper and lower references or envelopes Ienv_hi and Ienv_lo are stepped up and down by "the same" amount at the same time, this does not exclude negligible deviations.

Further, the driver disclosed herein is not just limited to driving LEDs. For instance, it could be used to drive other types of light source capable of coded light emission, or even other types of load other than light sources if it is desired to encode data into the output level of that load.

Further, with regard to the comparators CP1 and CP2, note that detection can be programmed on a low or high level of comparator output, or, alternatively, on a falling or rising edge of comparator output. So, the signs of the inputs to the comparators CP1 and CP2 do not matter as long as the signals are in the operating range of the comparators.

Other variations to the disclosed embodiments can be understood and effected by those skilled in the art. A single processor or other unit may fulfill the functions of several items recited in the claims. A computer program may be stored/distributed on a suitable medium, such as an optical storage medium or a solid-state medium supplied together with or as part of other hardware, but may also be distributed in other forms, such as via the Internet or other wired or wireless telecommunication systems.

The invention claimed is:

1. A circuit for driving a load, the circuit comprising:

output circuitry for connecting the circuit to the load, the output circuitry comprising one or more energy-storing components;

switching circuitry arranged to supply power from a power supply to the load by supplying a current through at least one of the energy-storing components of the output circuitry that resists a change in current, or applying a voltage across at least one of the energy-storing components of the output circuitry that resists a change in voltage; and control circuitry arranged to control the switching circuitry, to cause said current or voltage to oscillate between an upper envelope and a lower envelope;

wherein the control circuitry is configured to modulate data into said current or voltage by shifting the upper envelope between at least a first amplitude level and a second amplitude level, and by shifting the lower envelope by the same amount in the same direction at the same time;

wherein the control circuitry comprises a first comparator and a second comparator, the first comparator being arranged to bound the oscillation to the upper envelope by comparing feedback of said current or voltage to an upper reference signal, and the second comparator being configured to bound the oscillation to the lower envelope by comparing feedback of said current or voltage to a lower reference signal.

2. The circuit of claim 1, wherein the upper envelope is above zero for each of said levels, and the lower envelope is below zero for each of said levels.

3. The circuit of claim 1, wherein: the one or more energy-storing components comprise at least an inductor, the switching circuitry being arranged to supply power to the load by supplying said current through the inductor, and the control circuitry being arranged to cause said current to oscillate between the upper and lower envelope and to modulate the data into said current by said shifting of the upper and lower envelopes.

4. The circuit of claim 1, wherein: the one or more energy-storing components comprise at least a capacitor, the switching circuitry being arranged to supply power to the load by supplying said voltage across the capacitor, and the control circuitry being arranged to cause said voltage to oscillate between the upper and lower envelope and to modulate data into said voltage by said shifting of the upper and lower envelopes.

5. The circuit of claim 3, wherein the one or more energy-storing components comprise the inductor and a capacitor arranged together in a filter formation to smooth the current supplied to the load.

6. The circuit of claim 4, wherein the one or more energy-storing components comprise the capacitor and an inductor arranged together in a filter formation to smooth the voltage applied across the load.

7. The circuit of claim 1, wherein said shifting of the upper and lower envelopes is controlled by software.

8. The circuit of claim 7, wherein the software controls the shifting by controlling the upper and lower reference signals.

9. The circuit of claim 1, wherein the switching circuitry comprises a high side switch for connecting the output circuitry to a higher voltage supply rail of said power supply, and a low side switch for connecting the output circuitry to a lower voltage supply rail of said power supply; the control circuitry being configured to cause the oscillation to ramp up towards the upper envelope by asserting the high side switch, and to cause the oscillation to ramp down to towards the lower envelope by asserting the low side switch.

10. The circuit of claim 1, wherein the load comprises a light source and the output circuitry is connected to drive the light source.

11. The circuit of claim 10, wherein the light source comprises at least one LED.

12. The circuit of claim 1, wherein the circuit takes the form of a buck converter.

* * * * *